United States Patent [19]

Naegeli

[11] 4,350,198

[45] Sep. 21, 1982

[54] ANIMAL GATE, TRAINING MEMBRANES AND METHOD OF TRAINING THE ANIMAL TO USE SUCH GATE

[76] Inventor: Werner Naegeli, Burgstrasse 50, 8408 Winterthur, Switzerland

[21] Appl. No.: 232,311

[22] Filed: Feb. 6, 1981

[30] Foreign Application Priority Data

Feb. 22, 1980 [CH] Switzerland ..... 1412/80

[51] Int. Cl.³ ..... E06B 3/80

[52] U.S. Cl. ..... 160/179; 160/DIG. 8; 119/29

[58] Field of Search ..... 160/179, 180, DIG. 8, 160/354, 368 R; 119/19, 29

[56] References Cited

U.S. PATENT DOCUMENTS

| | | | |
|---|---|---|---|
| 1,643,939 | 10/1927 | Becker | 160/DIG. 8 |
| 2,560,661 | 7/1951 | Poovey | 160/179 |
| 2,699,826 | 1/1955 | Emerson | 160/DIG. 8 |
| 2,708,927 | 5/1955 | Dixon et al. | 160/DIG. 8 |
| 2,758,646 | 8/1956 | Johnson | 160/DIG. 8 |
| 2,832,406 | 8/1958 | Turenne | 160/179 |
| 2,854,070 | 9/1958 | Flanigan | 160/DIG. 8 |
| 3,692,082 | 9/1972 | Cromwell | 160/179 |

FOREIGN PATENT DOCUMENTS

| | | | |
|---|---|---|---|
| 293751 | 2/1965 | Australia | 160/179 |

*Primary Examiner*—Peter M. Caun

*Attorney, Agent, or Firm*—Werner W. Kleeman

[57] ABSTRACT

A gate or animal access door is disclosed which is assembled in an opening to permit passage of an animal from one room or area to another. The gate comprises two coacting elastic diaphragms or membranes, each of which has gaps to form membrane flaps. The membranes are held around the periphery thereof in a frame or holder in such a manner that as a result of their assembly in the frame the change of shape of the membranes causes them to be pressed together. The method of training the animal to use such gate contemplates employing in succession training membranes each having a progressively smaller central opening, inclusive of a membrane essentially devoid of any central opening, to thereby condition the animal to pass through the gate when it is ultimately assembled in the opening.

34 Claims, 17 Drawing Figures

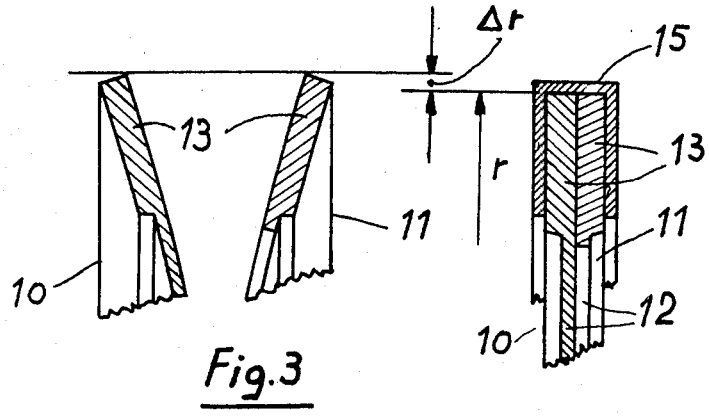
Fig.3
Fig. 3a
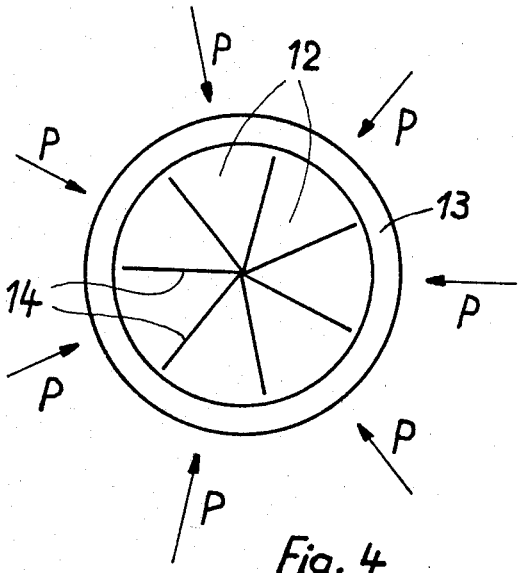
Fig. 4
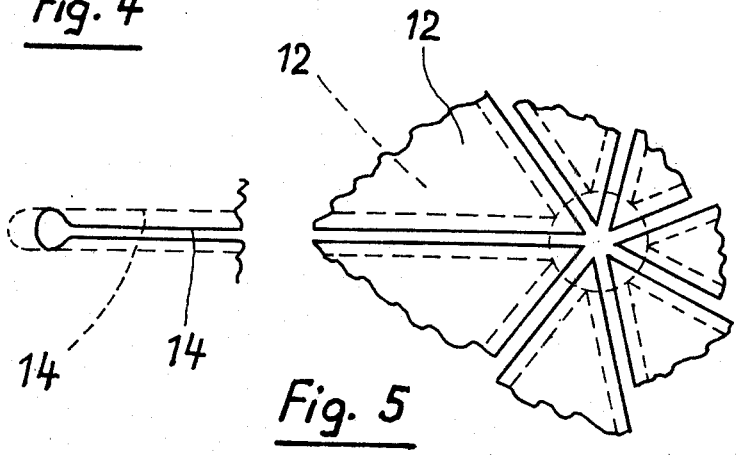
Fig. 5

ANIMAL GATE, TRAINING MEMBRANES AND METHOD OF TRAINING THE ANIMAL TO USE SUCH GATE

BACKGROUND OF THE INVENTION

The present invention relates to a new and improved construction of animal gate or access door, training diaphragms or membranes used in order to train the animal to use such gate, and also pertains to a novel method of training the animal so that it will make use of the gate or access door.

It is well-known to hang a piece of cloth or other material over openings in walls, doors and so forth for the passage of animals, in particular domestic animals, for example, from one inside room to the outside, for the purpose of reducing heat-loss. Such curtains are not draught-proof and are opened with almost no resistance by the smallest wind pressure, whereby the sealing effect deteriorates further and is practically useless.

For this reason it has already been suggested to seal such entrances or throughpass openings by means of a hinged stiff flap. Such flaps afford a better seal but are much too complicated and extravagant and have the further disadvantage that certain animal body parts, for instance, the tail, can become trapped, so that the animal subsequently refuses to go through.

For the above-mentioned reasons the attempt has already been made to build a sealing door in the throughpass opening or aperture and to control the opening and shutting sequence mechanically by means of photoelectric cells, delaying relays and so forth. Such installations are too complicated, unreliable and also too expensive, so that they are not marketable.

A prior art animal access door, as disclosed in British Pat. No. 1,133,170, possesses a round elastic membrane which is attached by means of a flange about the throughpass opening at a door. A membrane is divided by means of slits free of play into flexible flips.

What is disadvantageous with this construction is that after passage of an animal through the gate the edges of neighboring flaps abut one another due to the thickness of the membrane material and the low elastic restoring force of the flaps prevents their return into their original, in other words, their closed position. Therefore, such prior art constructions of animal gates are untight and thus fail to satisfactory fulfil the intended function.

It has also been proposed in U.S. Pat. No. 2,832,406 and French Pat. No. 1,453,979, to secure triangular panel elements formed of an elastic material at a frame having an elliptical throughpass opening. The plate or panel elements overlap in an imbricated fashion in the circumferential direction of the animal gate and thus form an elastically deformable closure layer formed of a multiplicity of individual parts.

Such gates, notwithstanding their single closure layer, are complicated in construction, require exact panel or plate elements of different shapes and an accurate and complicated assembly. Due to the imbricated overlapping of neighboring panel elements there is increased the thickness of the closure layer, starting from the periphery towards the center, to a multiple corresponding to the number of panel elements. At the center of the gate there prevail unpredictable conditions, which are dependent upon a number of factors. Also there is rendered questionable the effect of the overlapping due to the asymmetry of the panel or plate elements, attachment means and so forth. Following the passage of an animal the edges of neighboring panel elements tend to intertwine or become caught in one another during the return movement of the panel elements. Such prior art gates, notwithstanding their considerable constructional expenditure, are untight and do not fulfil their intended purpose in a satisfactory manner.

SUMMARY OF THE INVENTION

Therefore, with the foregoing in mind it is a primary object of the present invention to provide a new and improved construction of an animal gate or access door which is not afflicted with the aforementioned drawbacks and limitations of the prior art proposals.

Another significant object of the present invention aims at providing a new and improved construction of animal gate which is relatively simple in design, extremely reliable in operation, easy to use in a safe manner by the animal trained to use the same, with little or no likelihood of injury thereto, and while affording effective and reliable resealing of the animal gate after the animal has passed therethrough.

Yet a further significant object of the present invention is to provide a new and improved construction of animal gate which allows for safe and easy throughpassage of an animal, typically but not exclusively a cat, while affording effective sealing of the animal gate when not used so as to prevent heat losses from the interior of a structure and entry of undesirable environmental effects from the exterior into the interior of such structure.

Still a further significant object of the present invention aims at providing a novel method of training an animal to use such gate with the aid of specially designed training membranes.

Yet a further significant object of the present invention aims at providing a novel method of training an animal to use the gate which otherwise normally would not be used by such animal, and thus also effectively safeguarding against the entry of untrained i.e. foreign animals through such gate when mounted.

A further significant object of the invention is the provision of specially constructed training membranes or diaphragms which can be used for the purpose of training an animal to use the animal gate.

Now in order to implement these and still further objects of the invention which will become more readily apparent as the description proceeds, the animal gate or access door for the passage of animals, assembled in an opening which connects one room or area with another, is manifested by the features that there are provided two cooperating elastic membranes, each having gaps to thereby form membrane flaps. The membranes are held at their periphery in a frame or holder means in such a manner that due to change in shape of the membranes, as a result of the assembly thereof in the frame or holder means, the membranes are caused to be pressed together.

One of the major advantages of the gate of the present development is that by virtue of the necessary assembly of the membranes in a frame or other suitable holder the intrinsic tension necessary to give the required change of shape is simultaneously produced. The assembly of the membranes in the frame imparts the required change of shape to ensure that neither the gaps nor the flap tips are disturbed, i.e. that there is precluded contact at the gaps and also contact of the flap tips. This ensures that each individual membrane flap has a guaranteed freedom of movement which results in a complete reclosure of the gate with each passage of the animal therethrough, independent of direction.

If the gate is structured such that a flap of one membrane covers the gap between the corresponding opposite membrane flaps then there is afforded an improved sealing of the gate.

Other possibilities for improving the sealing and insulation effect, which are significant when bearing in mind the rising cost of energy at the present time, is to provide an originally closed membrane disk which subsequently is provided with slits to subdivide such into membrane flaps. Another technique is to provide membranes which originally are flat or planar and are then mounted in a frame having flat conical surfaces. Also the membranes can be designed such that there is formed therebetween a hollow space. A still further technique is to provide an insulating layer of air between the juxtaposed or mutually contacting membranes.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 illustrates a detail in section of two membranes prior to assembly;

FIG. 3*a* illustrates the membranes according to FIG. 3 after their assembly into a completed animal gate;

FIG. 4 diagramatically illustrates the effect of the forces resulting from the assembly of the membranes in the frame;

FIG. 5 illustrates the shape of a membrane gap both before and after assembly in the frame;

DETAILED DESCRIPTION OF THE PREFERRED EMBODIMENTS

Figure 1:
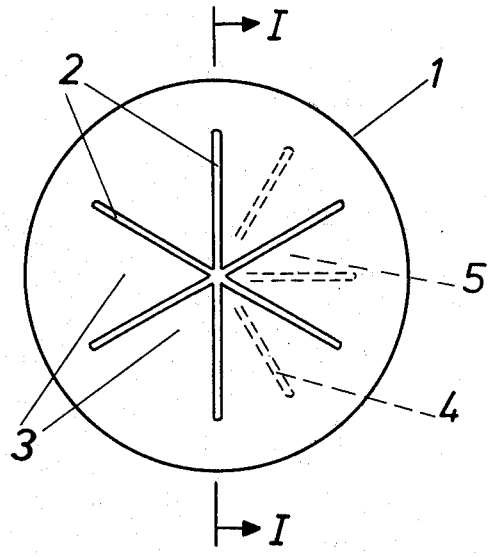
FIG. 1 illustrates a membrane in elevational view.
Figure 2:
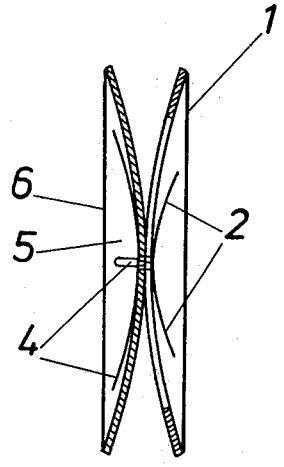
FIG. 2 illustrates two corresponding or coacting membranes prior to their assembly in a frame or other suitable holder, the sectional view of FIG. 2 being taken substantially along the line I—I of FIG. 1.

Describing now the drawings, in FIG. 1 there will be seen a centrally symmetric membrane 1 of elastic or pliable material which is subdivided by means of gaps 2 into a number of substantially sector-shaped membrane flaps 3 which are directed towards the center of the membrane or diaphragm 1. The gaps 2 and thereby the membrane flaps 3, depending on the material selected, are specially produced by means of injection molding, pressing, re-shaping, and so forth. The membrane 1 as shown in FIG. 2 has a convex or arched shape and works together with membrane 6 (which is similarly convex and subdivided by means of gaps 4 into flaps 5) through mutual central contact. The mutual position of the essentially identical membranes or diaphragms 1 and 6 is selected such that one flap 3 of the membrane 1 (FIG. 1) covers the gap 4 of the corresponding or coacting neighboring membrane flap 5 of the other membrane 6. Thus, an automatic sealing of the animal gate is achieved. In this position the two membranes 1 and 6 are built into a frame or holder 7. Assembly of the two membranes in the frame 7 is here of a special nature, whereby the diameter and the width of a circular or ring-shaped groove 8 are selected such that the two membranes 1 and 6 all around their circumference i.e. radially and axially with play, are guided so that they can float freely in the circular or ring-shaped groove 8, and by means of only the pin 9 introduced into the frame 7 are secured against rotation.

Figure 2A:
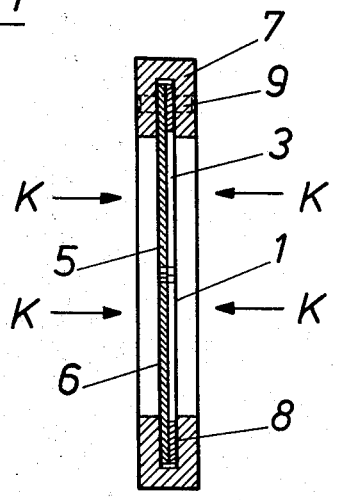
FIG. 2*a* illustrates the complete animal gate or access door with built-in membranes.

The change in shape in the unstressed condition of the convex or domed membranes 1 and 6 is brought about by the previously described assembly of the two membranes 1 and 6 in the frame 7, with the effect that the membrane flaps 3 and 5, as shown in FIG. 2*a*, are pressed against each other with forces K due to the internal tension.

In contrast to the constructional embodiment described in conjunction with FIGS. 1 to 2*a*, the convex or domed and originally slit membranes 10 and 11 as shown in FIGS. 3 to 5, as opposed to the membrane flaps 12 (FIG. 3*a*), possess a strengthened or thickened rim 13. For technical manufacturing reasons it is not possible to maintain the slit or gap 14 as small as one would wish. Therefore a more or less stamped-out hole is formed in the center of the gate as shown, dotted, in FIG. 5, which influences the sealing effect of the animal gate. An improvement is possible whereby the rims or marginal regions 13 of the membranes 10 and 11, as shown schematically in FIG. 4, are subjected to a radial inwardly directed pressure P. The gap 14 between the bordering flaps 12 and also the hole in the center of the membrane are thereby reduced as shown in detail in FIG. 5. The frame 15 serves as an additional aid whereby its inner radius r is retained smaller than that of the original membranes 10 and 11 by the amount $\Delta r$. This has been shown in FIGS. 3 and 3*a*. The gap 14 can be varied between required limits by changing the value $\Delta r$. As opposed to the construction previously described, here the two membranes 10 and 11 are held and secured in the frame 15 or equivalent structure by means of the thicker dimensioned rims. Safety pins are therefore not necessary.

Figure 6:
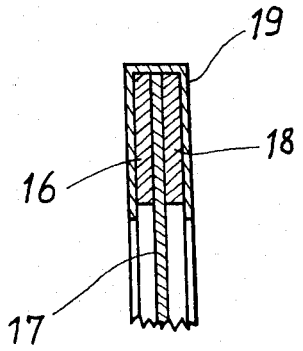
FIG. 6 illustrates a further constructional shape, in fragmentary sectional view, of an animal gate.

In a further embodiment as shown in FIG. 6, in order to increase the insulation effect, the animal gate is provided with three membranes with overlapping flaps. Membranes 16 and 18 are again convex, while the intermediate membrane 17 is flat. The clamping in the frame 19, depending upon requirements, may be accomplished according to the teachings described and shown in FIG. 3*a* or as described and shown with reference to FIG. 2*a*.

Figure 7:
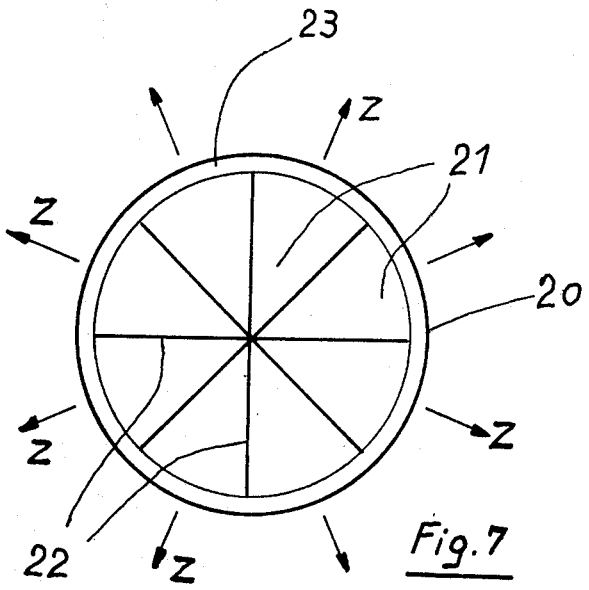
FIG. 7 illustrates a variation of the applied forces upon assembly of the membranes in a frame.

FIG. 7 shows an alternative constructional form of a gate. A membrane 20 is originally formed as a closed disc and individual membrane flaps 21 are produced by means of incisions 22. In order to guarantee the complete freedom of movement between the membrane flaps 21 the strengthened or reinforced rim 23 of the membrane 20 is subjected to a radial outwards tension or pull Z. The incision 22 is thereby increased in size to a small gap or slot which is changeable within limits as described below.

Figure 8:
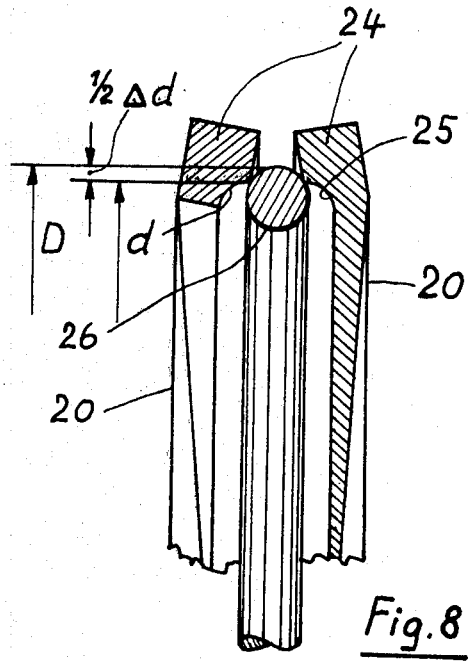
FIG. 8 illustrates in fragmentary sectional view a constructional shape of the membranes in accordance with FIG. 7 prior to their assembly.

A special shaped rim or marginal lip 24 (FIG. 8) serves this purpose. Its inside recess or cavity 25 has a diameter d which is smaller than the outside diameter D of a ring 26 by the amount Δd and which ring forms the inside part of a frame for the membranes 20. The radius of curvature of the recess or cavity 25 is made equal to or accomodated to the radius of the ring 26 in section. By pushing the membranes 20 on the ring 26 and by closing the frame using a U-shaped ring 27 the membrane flaps are elastically pressed together. Should the diameter of the ring 26 be increased by more than the amount Δd the gaps between the membrane flaps 21 would be enlarged, thereby increasing the mutual freedom of movement. While trying to achieve a minimal gap width in order to give the best sealing effect it must be borne in mind that the membrane flaps 21 must always practically completely close after the passage of an animal, regardless of direction.

Figure 8A:
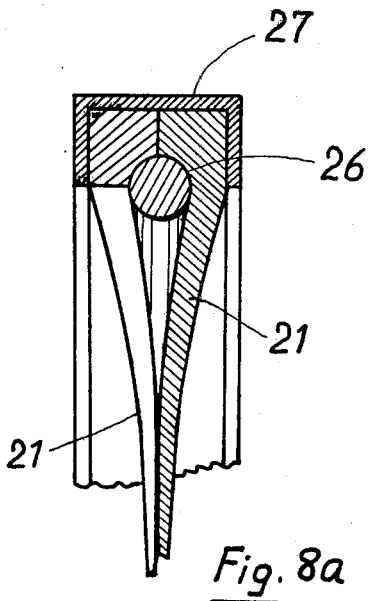
FIG. 8*a* illustrates the membranes of FIG. 8 following their assembly in a frame.

In order to reduce the opening force at the center of the gate the wall thickness of the membrane flaps 21 (FIG. 8*a*) reduces from the rim lip or bead 24 towards the center.

Figure 9:
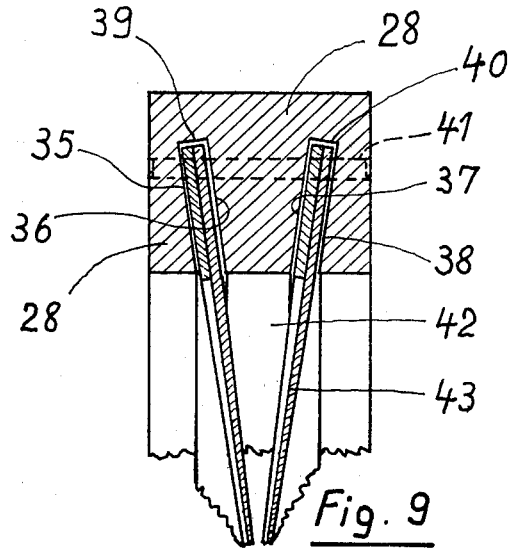
FIG. 9 illustrates a further constructional shape of the membranes and the frame in sectional view.
Figure 10:
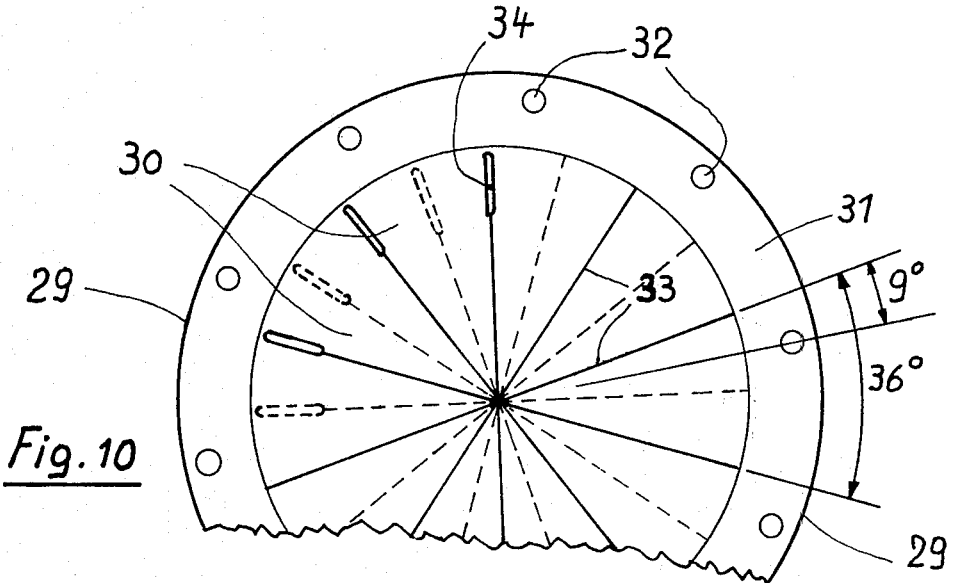
FIG. 10 is a front elevational view of one of the membranes according to the arrangement of FIG. 9.

In a further constructional example of an animal gate, as shown in FIG. 9, the frame 28 contains two similar pairs of membranes. One such membrane 29 is shown in FIG. 10. It has ten incisions 33 and ten sector-shaped membrane flaps 30 each with a 36° sector angle which equals the flap angle. There are ten offset holes 32 at 9° displaced in the flat rim or marginal zone 31 which equals one-quarter of the flap angle. The originally closed membrane 29 is also here subdivided by the centrally-running or radially extending incisions or cuts 33 in the membrane flaps 30. In the direction of the marginal zone or rim 31 it is however possible, according to a modified design, for the membrane 29 to possess originally produced slits 34 of lesser radial dimension. With such membranes only the part from slit 34 is subsequently cut to the center of the membrane 29. The thickness of the membrane flap 30 reduces on one side towards the center and the other side remains flat, such that the membrane is asymmetric.

The frame 28 has two grooves 39 and 40 limited by the conical surfaces 35 and 36 and 37 and 38 which surround, with play, the related membrane pair i.e. the membranes 29 are positioned together in pairs on the flat side in a floating manner in the grooves in the frame and are secured against rotation merely by means of the bolts or studs 41 or the like passing through the holes 32. At the same time the bolts or studs 41 ensure that the membranes 29 will not be unintentionally released from the frame 28.

The tip of the cone defined by the mutually contacting flat sides of the membranes and the groove 39, respectively, is located within the analogous cone of the groove 40. The two conical surfaces penetrate each other. As the membrane pairs are positioned in a floating manner in the grooves 39 and 40 of the frame 28 and the cone-shaped surface assembly does not lead to exaggerated changes in the shape of the membranes 29, the flaps connected to the rim 31 can be separated by the short slits 34 which ensures the complete freedom of movement of the membrane flaps 30 in this arrangement.

As can be seen from FIG. 9 the two membrane pairs enclose therebetween a hollow space 42 which tapers towards the membrane center. The separating layer of air 43 which is always available, trapped between the flat mutually contacting surfaces of two membranes 29, and which is particular to each membrane pair, produces a high insulation effect.

The flat sides of two membranes are placed together (FIG. 9), the four indentical membranes 29 are placed in the frame, the membrane pairs positioned at will on the bolts or studs 41 and the frame is closed. Thus, the animal gate is assembled simply and with high efficiency.

As shown for the various constructional examples the number of membrane flaps can vary. It is obvious that with the same membrane thickness at the base and the same elasticity of the material the resistance to the passage of the animal increases with reduced numbers of flaps. Conversely the passage resistance reduces under the same circumstances and dimensions with a large number of flaps. The characteristic of the animal gate therefore also can be changed in that the thickness of the membrane flaps reduces towards the center, for example in the case of a gate for house cats having a diameter of between 160–220 millimeters the membrane flap thickness reduces from 3 to 0.5 millimeters. By appropriate selection of the number of flaps, the elasticity of the material, the thickness of the membrane flaps, the original membrane shape, the manner of assembly in the frame only to mention a few of the most important variables, it is possible to meet every specific requirement for an animal gate.

A thermoplastic, vulcanized or sintered material can be used for the membranes or diaphragms. A transparent, or at at least translucent material could be psychologically advantageous to the animal. In order that the gates can meet the requirements of extreme climatic conditions a thermostable synthetic material should be used for the membrane.

With the heretofore known constructions of animal gates there was not provided any teaching concerning any training aids for the gates, which are required by the gate system and cannot be dispensed with when using flat or surface-like gates where, for instance, an animal such as a cat must penetrate therethrough with the application of force. Perhaps this explains, apart from the functional limitations and drawbacks, why such heretofore discussed prior art constructions of animal gates did not find any commercial acceptance.

Also the animal gate of the invention presents a solid closed and therefore impassable wall for the animal, and it would hardly attempt to pass through such a wall. It is however possible to overcome this psychological animal behaviour whereby passage of the animal through this impassable opening can be achieved during several separate phases by systematic habituation or training of the animal, here for instance assumed to be a cat.

Figure 11:
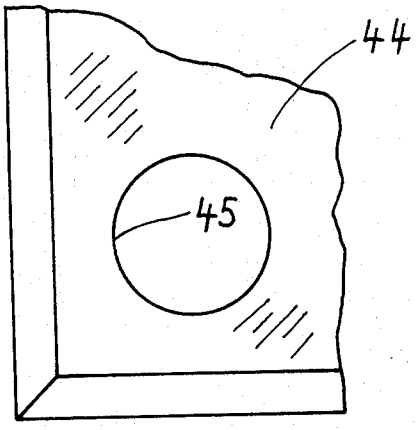
FIG. 11 illustrates in fragmentary front view a window pane provided with an opening and used for training the animal, such as a cat, to ultimately use the animal gate of the invention.

For instance in conjunction with, for example, an animal gate which is to be installed in a window pane and during a basically completely unmonitored teaching process the following procedures can be carried out:

Initially the animal, here as stated a cat, is permitted to become accustomed to pass through an opening 45 provided for the animal gate in a window pane 44 as shown in FIG. 11.

Figure 12:
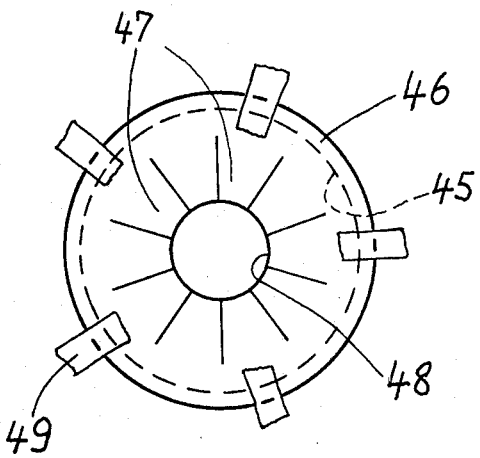
FIG. 12 illustrates the opening of the arrangement of FIG. 11 covered with a provisionally mounted training membrane.

Once the cat has understood that it is possible for it to leave, whenever it wishes, the dwelling by means of the opening 45 and can again reenter, then during the next training phase, and as shown in FIG. 12, the opening 45 is partially closed by a training membrane or diaphragm 46 formed of an elastic material and which possesses flaps 47 and at the membrane center a still relatively large size hole or opening 48. Since this part of the training requires relatively little time, it is sufficient for the purpose of securing the training membrane 46 to merely use adhesive strips or tape 49 or equivalent fastening means.

Figure 13:
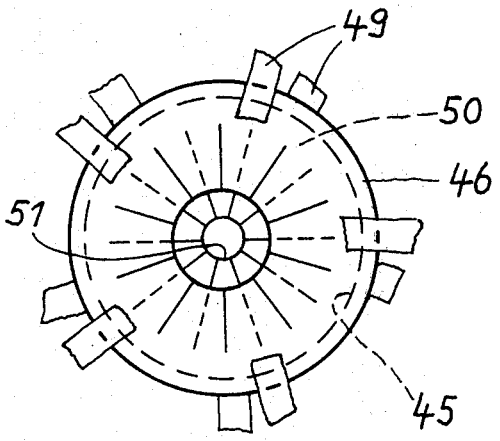
FIG. 13 illustrates the opening of the window pane covered with two training membranes.

After the cat has become familiar also with this condition, then during a next training period the membrane 46 can be replaced by a training membrane 50 having a small hole 51 at its center, or there can be attached a second membrane 50 and, as shown in FIG. 13, such can be secured at the opposite side of the window pane 44.

Figure 14:
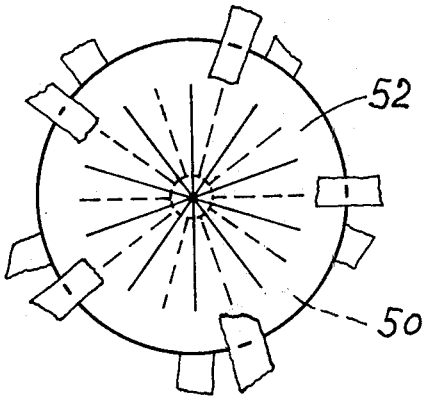
FIG. 14 illustrates a further combination of training membranes for training an animal to use the gate of the invention.

Once this part of the training phase has been completed, then as best seen by referring to FIG. 14, by exchanging the membrane 46 for a training membrane 52 without any hole or opening at the center, there can be performed the last part of the training of the cat. Then it is possible to go over to the definite use of the inventive animal gates by mounting one such gate in the window pane opening 45.

In many instances the training of the animal may progress so rapidly that it is possible to dispense with the use of the membrane 50.

For new cats of the owner the training process can be repeated without any problem in that after dismantling the animal gate the training process is repeated as aforedescribed with the empty opening 45 in the window pane 44.

During the whole, nevertheless limited transitional period it is understood that with such training membranes, notwithstanding the care required in assembly, the sealing and insulation effect is greatly reduced.

The passage of an animal, such as a cat, through a closed and multi-flapped animal gate will be a pleasurable undertaking as the cats find the stroking effect of the membrane flaps pleasing when passing through the gate.

The gate, as described, seems to hinder the passage, for instance, entrance of alien cats.

While there are shown and described present preferred embodiments of the invention, it is to be distinctly understood that the invention is not limited thereto, but may be otherwise variously embodied and practiced within the scope of the following claims. Accordingly,

What I claim is:

1. An animal gate for the passage of animals and which is arranged in an opening which connects one room or area with another, comprising:

at least two coacting elastic membranes;

each of said elastic membranes being provided with gap means forming membrane flaps; and frame means for retaining the membranes at their circumference in such a manner that as a result of assembly of the membranes in the frame means the membranes undergo a change in shape which causes said membranes to be pressed against one another.

2. The animal gate as defined in claim 1, wherein:

each of said membranes possesses a substantially centrally symmetrical configuration; and each of said membranes having a multiplicity of said membrane flaps.

3. The animal gate as defined in claim 1, wherein:

said coacting membranes are positioned with respect to one another such that a flap of one of the membranes covers the gap means between membrane flaps of the other oppositely situating coacting membrane.

4. The animal gate as defined in claim 1, wherein:

each of said membranes is structured so as to originally possess the membrane flaps.

5. The animal gate as defined in claim 1, wherein:

each of said membranes comprises an originally closed membrane disk which after application of slits constituting said gap means is subdivided into membrane flaps.

6. The animal gate as defined in claim 5, wherein:

said frame means cooperates with said membranes such that following assembly of said membranes in said frame means the size of said slits defining said gap means can be altered.

7. The animal gate as defined in claim 1, wherein:

said frame means cooperates with said membranes such that by virtue of assembly of said membranes in said frame means it is possible to alter the size of said gap means.

8. The animal gate as defined in claim 1, wherein:

said frame means serves to floatingly retain said membranes.

9. The animal gate as defined in claim 1, further including:

means for securing said membranes against rotation.

10. The animal gate as defined in claim 1, wherein:

each of said membranes have an originally domed configuration; and said frame means comprises a substantially flat frame means in which there are assembled said domed membranes.

11. The animal gate as defined in claim 1, wherein:

said frame means contain substantially cone-shaped surface means; and said membranes possess an originally substantially flat configuration and are assembled into said cone-shaped surface means of said frame means,

12. The animal gate as defined in claim 1, wherein:

each of said membranes has a marginal zone; and said frame means exerting a radially inwardly directed pressure at the marginal zone of each of said membranes.

13. The animal gate as defined in claim 1, wherein:

each of said membranes possesses a marginal zone; and said frame means being structured so as to exert a substantially radially outwardly directed traction force upon the marginal zone of each of said membranes.

14. The animal gate as defined in claim 1, wherein:

each of said membrane flaps are formed by first providing incisions in the membrane and subsequently providing slits thereat.

15. The animal gate as defined in claim 1, wherein:

said coacting membranes enclose therebetween a hollow space.

16. The animal gate as defined in claim 1, wherein:

each of said membranes has a marginal zone provided with holes serving for mounting the related membrane in the frame means; and each two neighboring holes of a membrane being offset from one another through approximately one-quarter of a sector angle of a membrane flap.

17. The animal gate as defined in claim 1, wherein:

each of said membranes has a marginal zone; and the thickness of the membrane flaps decreasing from the marginal zone of the related membrane towards the center thereof.

18. The animal gate as defined in claim 1, wherein:

each of said membranes is formed of at least a translucent material.

19. The animal gate as defined in claim 1, wherein:

the membranes are formed of a thermostable plastic.

20. The animal gate as defined in claim 1, wherein:

two respective pairs of said membranes are provided;

each two membranes of a pair forming at juxtaposed surfaces thereof a substantially conical configured pair of membranes; and the cones of both pairs of membranes overlapping.

21. The animal gate as defined in claim 20, further including:

an insulating layer of air provided between the juxtaposed membranes.

22. The animal gate as defined in claim 5, wherein:

at least one of said membranes is individually used and serves as an integrated part of the gate as a training membrane.

23. The animal gate as defined in claim 22, wherein:

said training membrane possesses at its central region a hole.

24. A training membrane for use with an animal gate having at least two coacting flexible membranes provided with membrane flaps, comprising:

a flexible training membrane member having membrane flaps and intended to be secured over an opening through which the animal is trained to pass therethrough; and said training membrane having a central opening.

25. The training membrane as defined in claim 24, further including:

a further flexible training membrane provided with membrane flaps and positionable to cooperate with the other first membrane.

26. The training membrane as defined in claim 25, wherein:

said further training membrane is provided with a smaller central opening.

27. The training membrane as defined in claim 25, wherein:

said further training membrane is practically devoid of any central opening.

28. A training membrane for training an animal to use an animal gate containing at least two flexible coacting membrane members provided with membrane flaps, comprising:

a flexible membrane member provided with membrane flaps and practically devoid of any opening at its central region.

29. A method of training an animal to pass through an opening which connects one room or area with another, comprising the steps of:

temporarily securing a first elastic training membrane having membrane flaps and a central hole over the opening;

training the animal to pass through the central hole of the membrane until it recognizes that passage through such central hole of the membrane permits it to move between respective areas at opposite sides of the membrane;

replacing such membrane with a further elastic membrane having membrane flaps; and training the animal to pass through said further membrane.

30. The method as defined in claim 29, further including the steps of:

using as the replacement membrane a membrane having a smaller central hole.

31. The method as defined in claim 29, further including the steps of:

using as the further membrane a membrane essentially devoid of any central opening.

32. The method as defined in claim 29, further including the steps of:

instead of replacing the first membrane by the further membrane using a second membrane which is placed over the first membrane and training the animal to pass through both of said membranes.

33. The method as defined in claim 32, wherein:

said second membrane has a smaller central opening.

34. The method as defined in claim 32, wherein:

said further membrane is essentially devoid of any central opening.

* * * * *